US008723746B1

(12) United States Patent
Doane

(10) Patent No.: US 8,723,746 B1
(45) Date of Patent: May 13, 2014

(54) SLOTTED GROUND PLANE ANTENNA

(75) Inventor: Jonathan P. Doane, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 572 days.

(21) Appl. No.: 12/571,541

(22) Filed: Oct. 1, 2009

(51) Int. Cl.
*H01Q 19/00* (2006.01)

(52) U.S. Cl.
USPC ..... 343/756

(58) Field of Classification Search
USPC ..... 343/767–772, 756, 790
See application file for complete search history.

(56) References Cited

U.S. PATENT DOCUMENTS

| | | | | | |
|---|---|---|---|---|---|
| 4,197,549 | A * | 4/1980 | Collins | 343/771 |
| 4,843,400 | A * | 6/1989 | Tsao et al. | 343/700 MS |
| 4,853,704 | A * | 8/1989 | Diaz et al. | 343/767 |
| 5,065,164 | A | 11/1991 | Deasy | |
| 5,124,713 | A * | 6/1992 | Mayes et al. | 343/700 MS |
| 5,255,004 | A * | 10/1993 | Berkowitz et al. | 343/853 |
| 5,402,136 | A * | 3/1995 | Goto et al. | 343/729 |
| 5,714,961 | A * | 2/1998 | Kot et al. | 343/769 |
| 6,020,854 | A | 2/2000 | Jagnow et al. | |
| 6,160,512 | A * | 12/2000 | Desclos et al. | 343/700 MS |
| 7,064,725 | B2 * | 6/2006 | Shtrikman et al. | 343/770 |
| 7,088,302 | B2 * | 8/2006 | Louzir et al. | 343/769 |
| 7,176,844 | B2 * | 2/2007 | Chiang et al. | 343/815 |
| 7,554,506 | B2 | 6/2009 | Chung et al. | |
| 2003/0201941 | A1 * | 10/2003 | Aikawa et al. | 343/700 MS |
| 2005/0052321 | A1 * | 3/2005 | Lee et al. | 343/700 MS |
| 2006/0097935 | A1 * | 5/2006 | Colburn et al. | 343/713 |
| 2007/0171139 | A1 * | 7/2007 | King et al. | 343/767 |
| 2007/0200764 | A1 * | 8/2007 | Cho et al. | 343/700 MS |
| 2010/0097274 | A1 * | 4/2010 | Rao et al. | 343/702 |

* cited by examiner

*Primary Examiner* — Huedung Mancuso
(74) *Attorney, Agent, or Firm* — Donna P. Suchy; Daniel M. Barbieri

(57) ABSTRACT

An antenna structure including a ground plane is capable of producing an EM interference pattern to produce signal gains at a zenith of the antenna. The slots in the ground plane are positioned at a predetermined distance from a radiator and extend a predetermined distance from the axis of the antenna. The slots generate an interference pattern relative to the radiated signal to create a circular polarization thereby producing a signal gain at the zenith of the antenna. The slots may be provided during the manufacturing process of the ground plane or added later to existing antennas.

25 Claims, 9 Drawing Sheets

SLOTTED GROUND PLANE ANTENNA

BACKGROUND

Monopole antennas are a common and inexpensive way to radiate an omnidirectional signal. The vertical radiator of a basic monopole antenna may include a ground to plane redirect a portion of the radiated electromagnetic energy over the surface of the earth. Otherwise a portion of the radiated energy may be lost, constructively cancelled, or dissipated. The ground plane may comprise the earth's surface or an artificial metallic or conductive plate that serves as an electromagnetic field reflector. The present disclosure, however, concerns an improvement to artificial ground planes. A monopole antenna having an artificial conductive plate ground plane, for example, simulates the function of a dipole antenna. Furthermore, the functionality of a monopole antenna with a sufficiently large ground plane approaches that of a dipole antenna.

Standard monopole antennas are vertically polarized elements that may produce an electromagnetic field over a ground plane. Monopole antennas produce null emissions at their zeniths, which make them ill suited for short range communications at high incident angles. The null at zenith also prevents full hemispherical coverage which is more important in airborne links from a ground station.

Previous techniques to fill null emission patterns included bending the monopole element. Unfortunately, this technique requires extraordinary precision and advanced manufacturing methods, especially at high frequencies. Bending of the monopole element also distorts the azimuthal symmetry of the pattern.

It is therefore an object of the present invention to provide a new antenna with a structure to partially obviate null emission patterns at its zenith.

It is further an object of the present invention to provide an existing antenna with a ground plane structure to at least partially fill otherwise null emission patterns at its zenith.

It is another object of the present invention to provide an antenna with an inexpensive mechanism to reduce null emission patterns at its zenith without bending the radiator element.

SUMMARY OF THE INVENTION

The present invention provides an antenna with the capability of filling a null at zenith. The invention takes advantage of slots in the ground plane which produce a measurable amount of circularly polarized radiation toward the zenith. The slots interrupt the currents and redirect energy into space.

The angle and the distance of the slots from the center of the monopole play a critical role in the amount of radial current redirected and the phase of the redirected energy respectively. A radial slot will not interrupt the radial current and will therefore not radiate; whereas slots perpendicular to the radius interrupt the most current and radiate the strongest. One embodiment utilizes an angle of forty-five degrees for the slots. In addition to the angle of the slots, this embodiment utilizes two slots that radiate vertically and two slots that radiate horizontally. The slots are spaced to cause a ninety degree phase difference. The ninety degree phase difference radiates circular polarization toward the zenith.

As there is no preferred azimuthal orientation, the circular polarization fills the null for all azimuthal orientations. The pattern at zenith corresponds to shorter ranges; therefore, a minimal gain of between −10 to −15 dB is useful at the zenith. In addition to reducing null depth by approximately 20 dB, the pattern of the monopole near the horizon is relatively unaffected. The present invention may be utilized while constructing a new antenna or in retrofitting or modifying an existing antenna.

DETAILED DESCRIPTION

Figure 1:
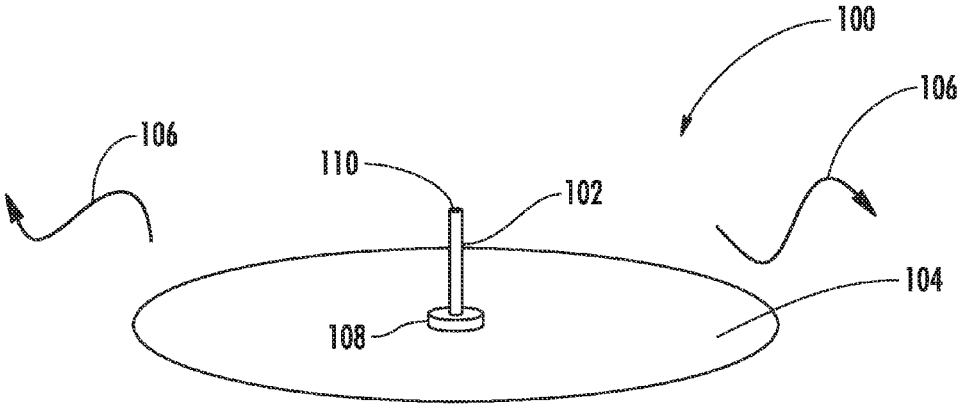
FIG. 1 is a perspective view of a standard monopole antenna including a ground plane comprising a conductive material.

Now referring to the drawings, FIG. 1 shows a standard monopole antenna 100 comprising a vertical radiator 102 and a ground plane 104. The monopole antenna 100 radiates an RF signal 106 radially outward from a vertical axis thereof. The radiator 102 further comprises a first end 108 and a second end 110. Above the second end 110, a zenith 112 is devoid of any signal 106. It should be recognized that the invention can be applied to an antenna with a radiator and ground pole.

Figure 2:
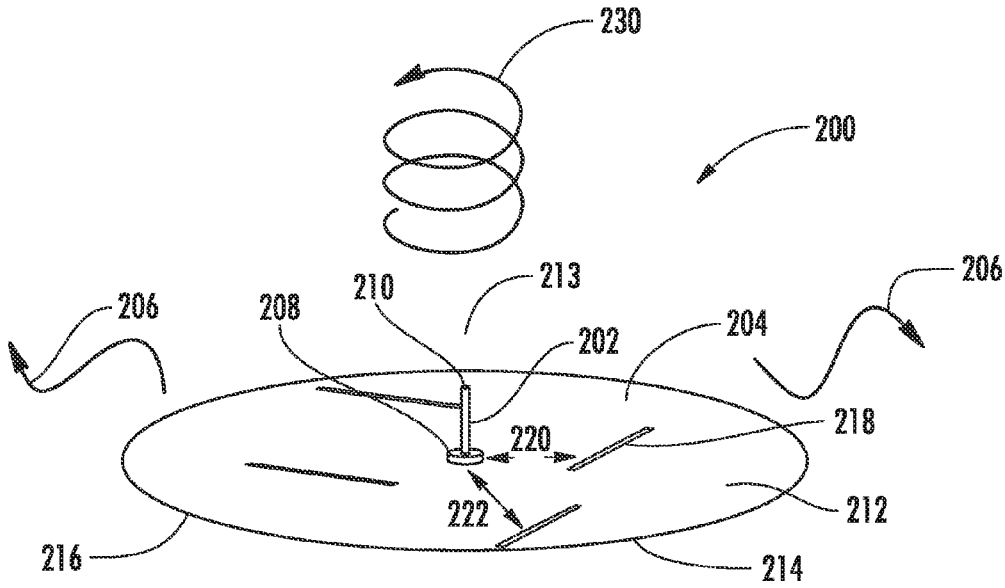
FIG. 2 is a perspective view of a monopole antenna with a slotted ground plane.

FIG. 2 shows a monopole antenna 200 comprising a radiator 202 and a ground plane 204. The monopole antenna 200 radiates a signal 206 radially outward from the vertical axis of the radiating element 202. The radiator 202 further comprises a first end 208 and a second end 210. A zenith 213 is located above the second end 210. The ground plane 204 further comprises a first metallic or conductive surface 212, a second metallic or conductive surface 214. The ground plane has a given thickness 216 between the first surface 212 and the second surface 214. The thickness 216 may be of the same conductive material or metal of the first surface 212 and second surface 214 or be made of an insulating material. The ground plane 204 contains a series of slots 218.

The slots 218 in the ground plane redirect induced currents in the ground plane which, in turn, stabilize an interference pattern in the signal 206 to redirect energy towards the zenith. The slots 218 may traverse a portion of the insulator thickness 216 or the entire thickness 216. For thin ground planes, the slot preferably runs the entire thickness of the ground plane. For thicker ground planes, it may be sufficient for the slots to only span a portion of the thickness to obtain a desired signal pattern. The angle of the slots 218 relative to a radius of the ground plane determines the extent of induced current flow in the ground plane and the amount of energy redirected. Radial slots do not interrupt radial EM emissions; while slots perpendicular to the radius interrupt a greater amount of EM emissions. Depending on the orientation of the slot angle, the EM emission may radiate horizontally or vertically. The number of slots 218 also may be varied to increase symmetry of the radiated signal.

In addition to the angle of the slots relative to a radius of the ground plane, the distance of the slots 218 from the radiator 202 determine the phase of the redirected EM emissions. Again referring to FIG. 2, a series of slots 218 are shown at a first distance 220 and a second distance 222 from the radiator 202. The first distance 220 and the second distance 222 are such that they cause the signal 206 to be out of phase. The phase difference caused by the slots 218 is preferably ninety degrees. The ninety degree phase difference along with the horizontal and vertical radiation produces a circular polarization 230 towards the zenith 213.

The circular polarization 230; therefore, fills the null at the zenith 213. As there is no preferred azimuthal orientation at the zenith 213, the circular polarization is effective for filling the signal null at all azimuthal orientations. The gain needed at the zenith 213 corresponds to shorter ranges; hence only a minimal gain is needed at the zenith 213. A gain of −10 to −15 dB can provide sufficient gain while the pattern of the monopole antenna 200 is relatively unaffected. Any fill in the null is detrimental to side radial radiation and can be thought of a zero sum. Thus, any amount gained at the null is lost radially.

Figure 3:
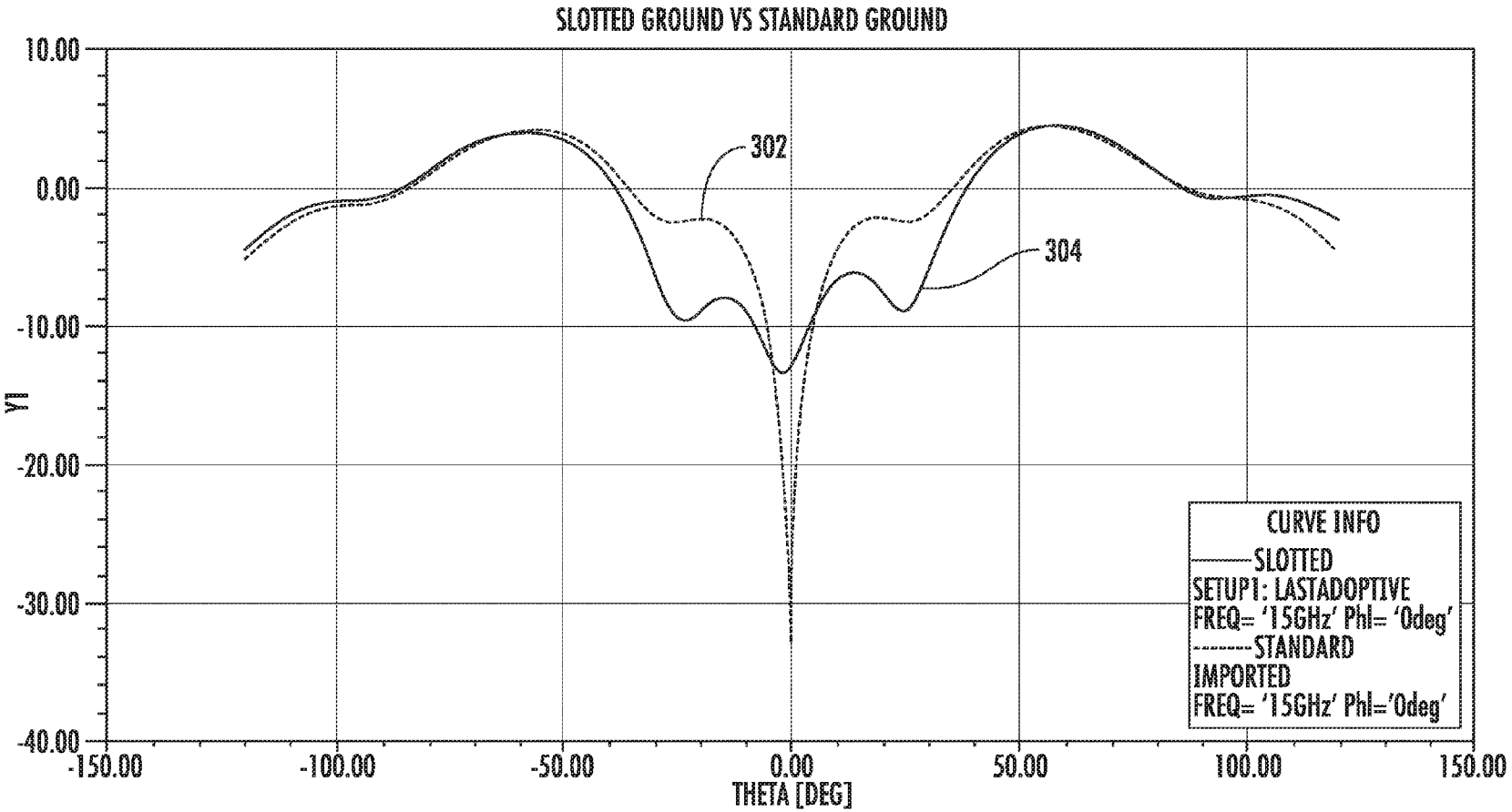
FIG. 3 is a comparison of radiation patterns of a standard monopole antenna and a monopole antenna with a slotted ground plane.

Now referring to FIG. 3, the radiation pattern a standard monopole antenna compared to a monopole antenna containing slots in the ground plane in terms of the EM radiation pattern. The standard monopole antenna pattern is depicted by dashed line 302, while the monopole antenna containing slots pattern is depicted by the solid line 304. The x-axis is in degrees while the y-axis is in decibels. The zenith of both antennas is depicted at zero degrees. The monopole antenna containing slots has a gain at zenith of about twenty decibels.

Figure 4:
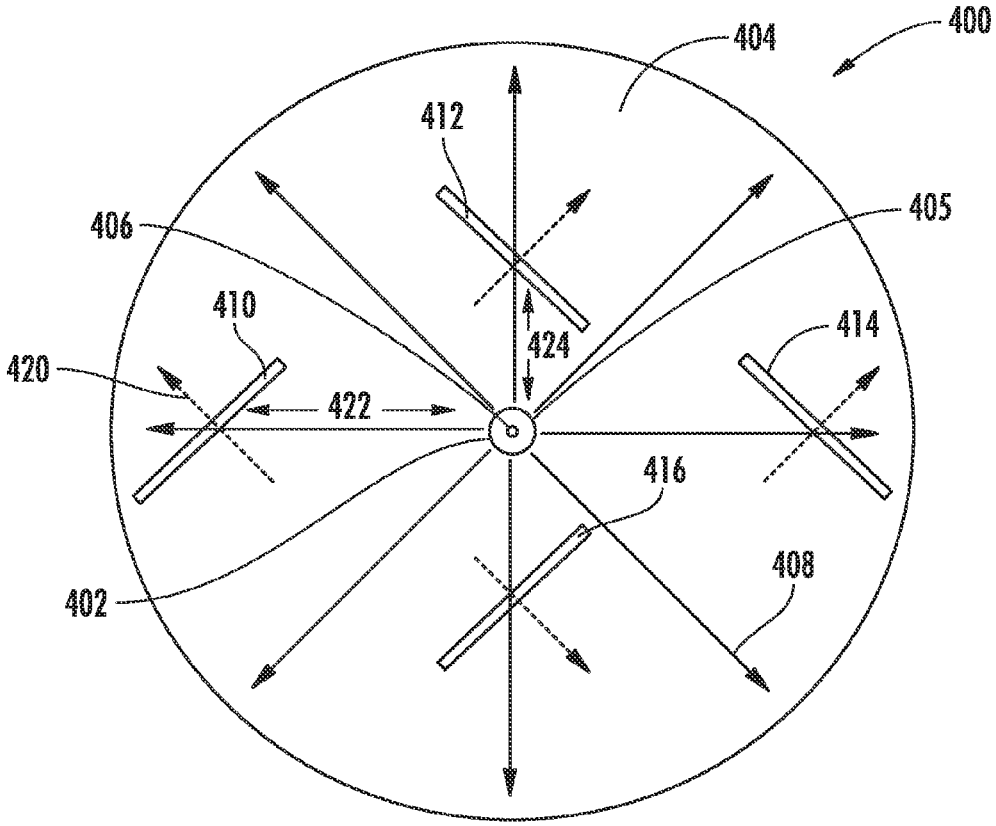
FIG. 4 is a top view of a monopole antenna with a slotted ground plane.
Figure 5:
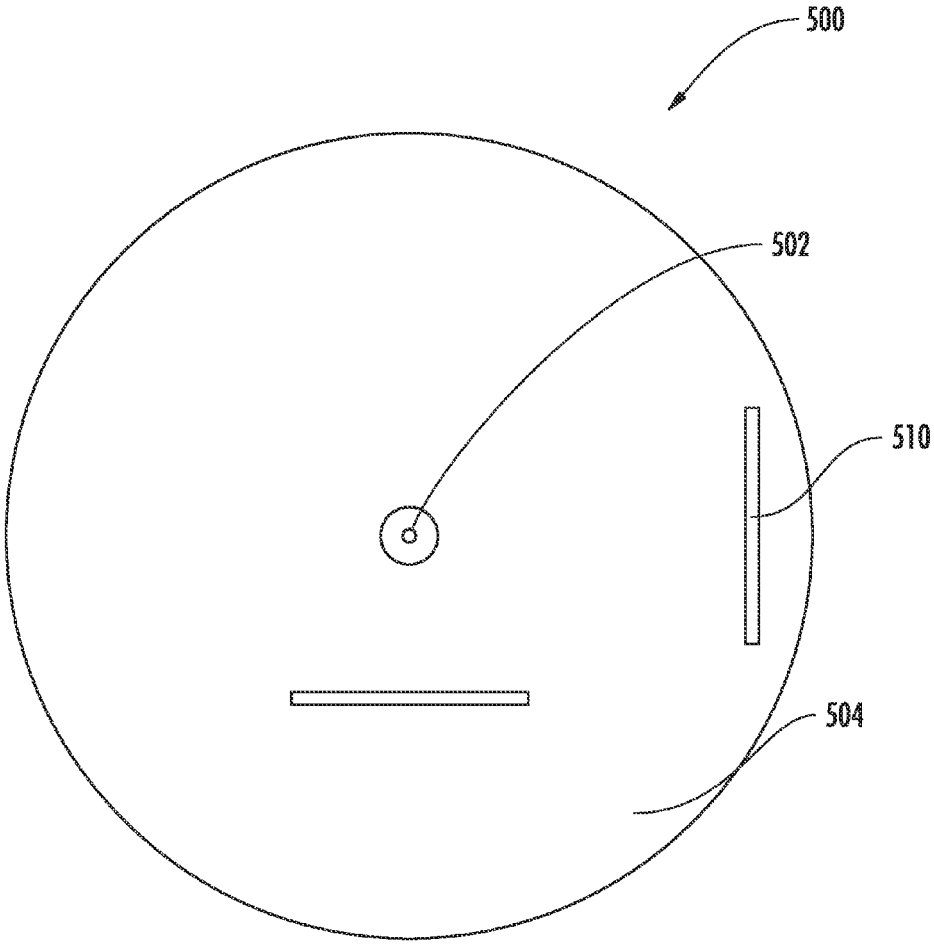
FIGS. 5-9 are top views of several embodiments of a slotted ground plane monopole antennas.
Figure 6:
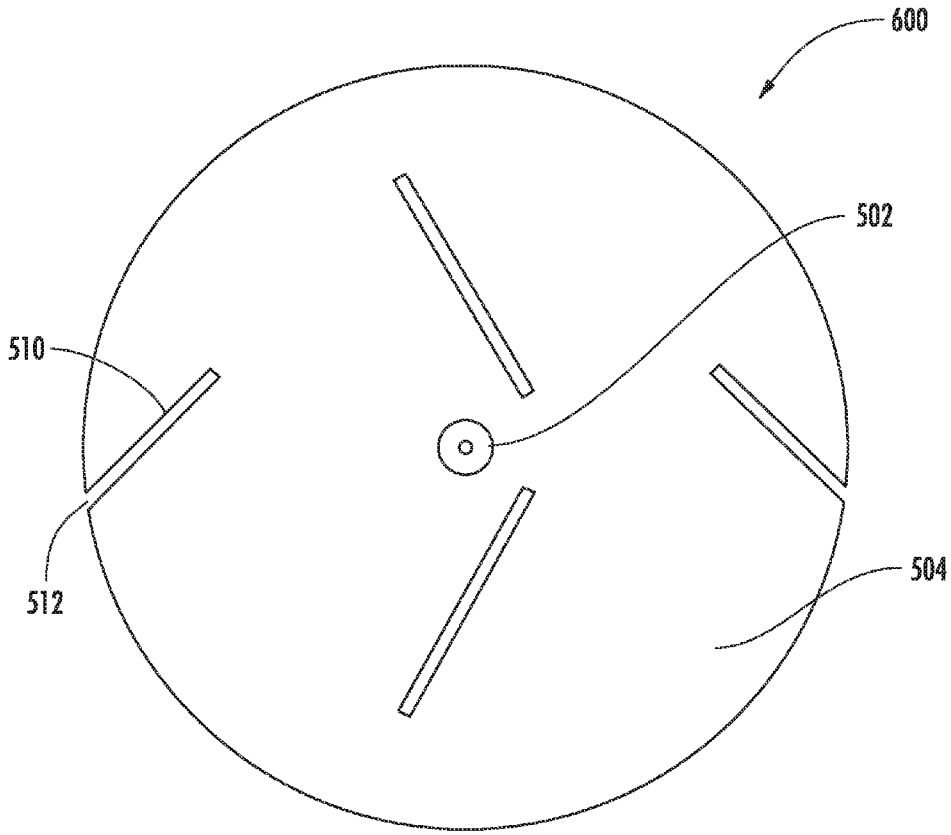
Figure 7:
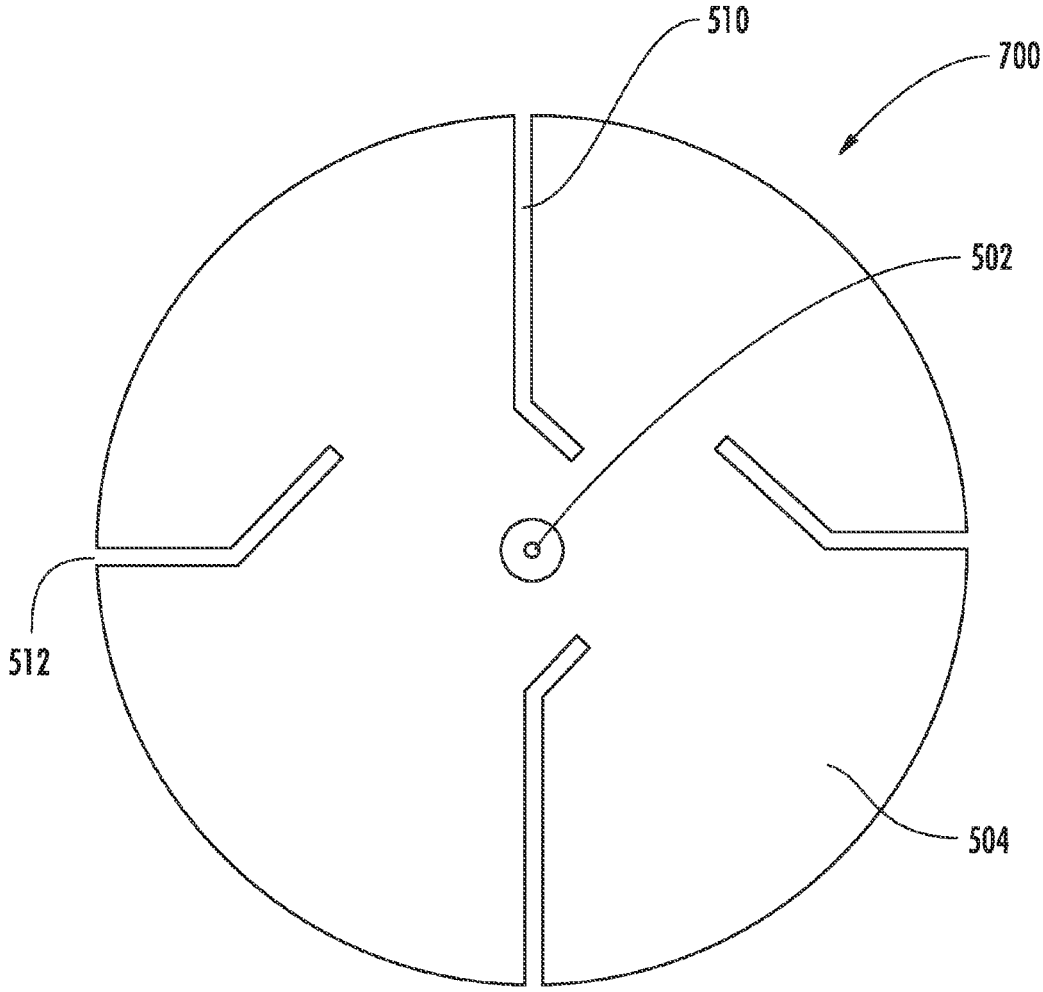
Figure 8:
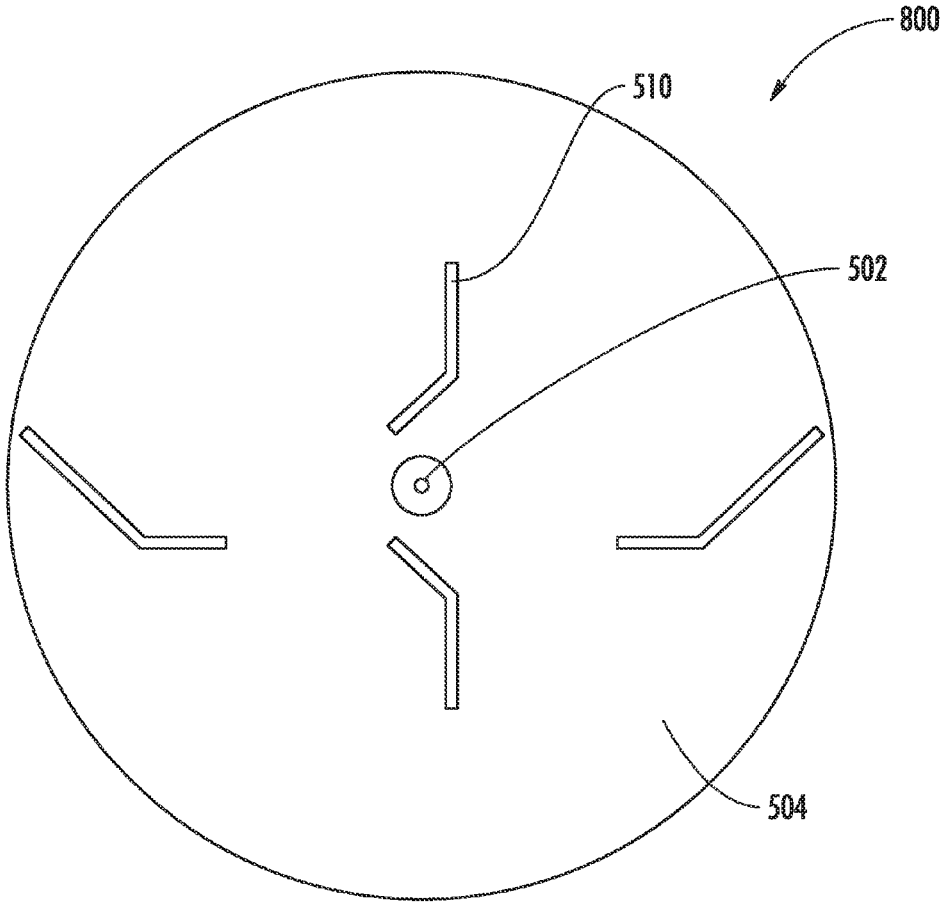
Figure 9:
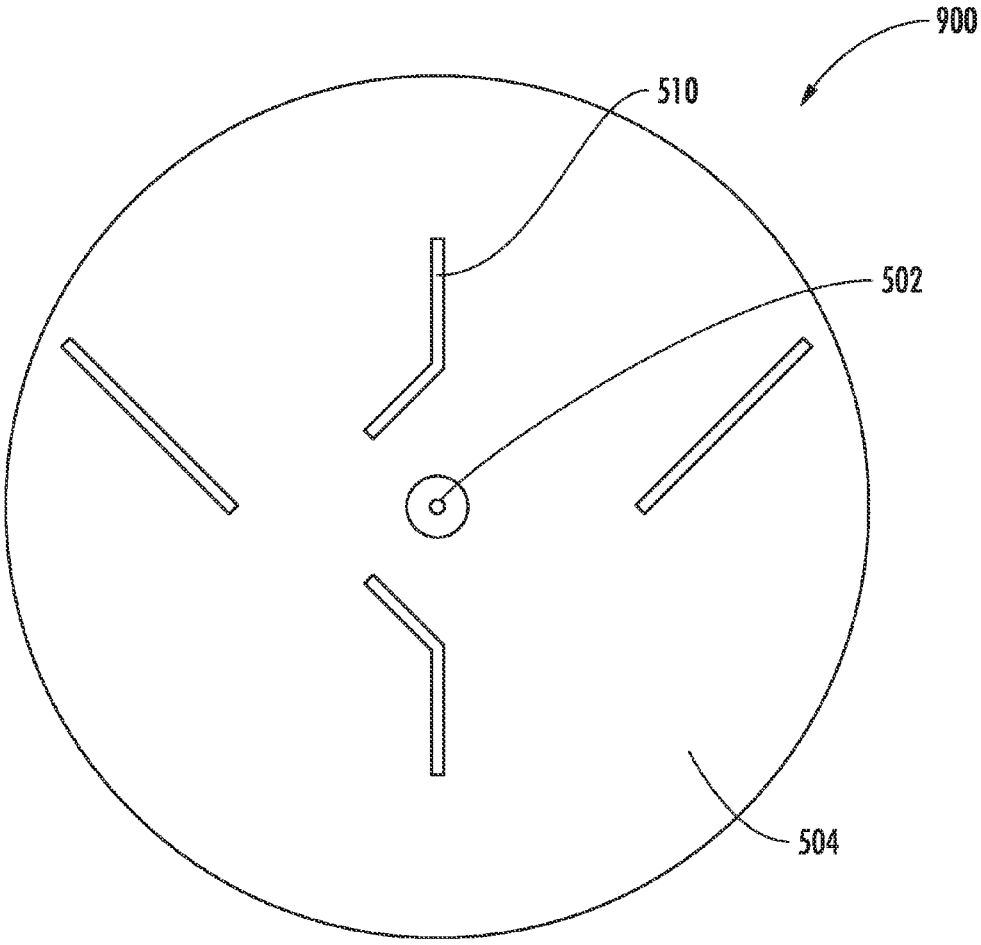

As detailed above, the number of slots, the angle of the slots relative to the ground plane radius, the distance of the slots, as well as the size and shape of the slots has an effect on the signal radiated by the slots. Each of the variables can be adjusted to develop a preferred particular embodiment for each antenna. Now referring to FIG. 4, one embodiment of the invention is detailed. Monopole antenna 400 comprises a radiator 402 and a ground plane 404 that is preferably disc shaped and planar having a radius and a diameter, and made of metal or some other conductive material. The radiator 402 is attached to the ground plane 404 at a center 406 of the ground plane 404. The radiator 402 further comprises a free end 405. The radiator 402 and the ground plane 404 are capable of radiating a signal. The ground plane 404 contains ground currents 408.

The ground plane 404 further comprises a first slot 410, a second slot 412, a third slot 414 and a fourth slot 416, each having a long dimension and a short dimension. The slots 410, 412, 414 and 416 are positioned such that the slots make a forty five degree angle relative to the ground currents 408. The slots 410, 412, 414 and 416 interrupt the ground current 408 and produce a radiated polarization 420 perpendicular to the long dimension of the slots 410, 412, 414 and 416. The slots 410, 412, 414, and 416 are oriented such that two of the slots 410, 412, 414 and 416 radiate vertically and two of the slots 410, 412, 414, and 416 radiate horizontally. Slots 410 and 416 are further oriented such that they are perpendicular to slots 412 and 414.

Again referring to FIG. 4, slots 410 and 414 are a first distance 422 from the center 406 and the radiator 402. Slots 412 and 416 are a second distance 424 from the center 406 and the radiator 402. Additionally, slots 412 and 416 are one hundred eighty degrees from one another as measured from the center 406, and slots 410 and 414 are one hundred eighty degrees from one another. The distance of the slots from the radiator 402 determines the phase of the radiated polarization 420. This embodiment has the first distance 422 and the second distance 424 positioned relative to one another that they cause a ninety degree phase shift. The combination of horizontal radiation, vertical radiation and the ninety degree phase shift produce circular polarization towards the free end 405 of the radiator 402. The circular polarization produces a gain at the free end 405 and fills the signal null at zenith.

Now referring to FIGS. 5, 6, 7, 8, and 9, several alternate embodiments are shown. The monopole antennas 500, 600, 700, 800 and 900 each comprise a radiator 502 and a ground plane 504. The ground plane 504 has a diameter and a radius. Each ground plane 504 contains a series of slots 510. The slots 510 may be of differing sizes, shapes, numbers, and distances from the radiator 502, as well as have varying angles relative to the radius. Additionally, the slots 510 may be contained within the ground plane 504 or continue to an edge 512 of the ground plane 504 such as in monopole antennas 600 and 700. The possible embodiments are limitless; however, the slots 510 must be able to produce a polarization that fills a signal null at zenith. Furthermore, the principles are written in terms of monopole antennas; however, those principles are also applicable to other antennas.

The slots in the embodiments may be made during the initial construction of the monopole antenna or by retrofitting or modifying existing monopole antennas. The slots may be made separately or with the manufacture of the ground plane, by stamping, chemical material removal, cutting, laser cutting, plasma cutting, water-jet cutting, a circuit board manufacturing process, or any other similar or known processes. Furthermore, the ground plane may also be a layer on a substrate.

Having thus described the invention in connection with the several embodiments thereof, it will be evident to those skilled in the art that various revisions can be made to the several embodiments described herein with out departing from the spirit and scope of the invention. It is my intention, however, that all such revisions and modifications that are evident to those skilled in the art will be included with in the scope of the following claims. Any elements of any embodiments disclosed herein can be used in combination with any elements of other embodiments disclosed herein in any manner to create different embodiments.

What is claimed is:

1. An antenna, comprising:

a ground plane; and a radiator extending from the ground plane to radiate a signal;

the ground plane including at least one slot positioned therein to polarize a portion of an EM signal emanating through the ground plane in a direction of a free end of the radiator to increase a signal gain at a null position of the antenna;

the at least one slot being entirely radially separated a distance from the radiator;

the ground plane having a first conductive surface, a second conductive surface and a thickness between the first conductive surface and second conductive surface;

the at least one slot traversing at least a portion of the thickness;

the at least one slot comprising a first slot, a second slot, a third slot and a fourth slot;

the first slot and the third slot being a first distance from the radiator;

the second slot and the fourth slot being a second distance from the radiator;

the first distance and the second distance being such to cause a ninety degree phase shift of the signal.

2. The antenna of claim 1 wherein:

the at least one slot radiates the signal both horizontally and vertically, the at least one slot creates circular polarization.

3. The antenna of claim 2 wherein:

the first slot and the third slot comprise a first angle relative to one another;

the second slot and the fourth slot comprise a second angle relative to one another;
the first angle is ninety degrees;
the second angle is ninety degrees.

4. The antenna of claim 3 wherein:
the ground plane is a disc,
the disc has a diameter and a center;
the radiator extends normally from the center.

5. The antenna of claim 1, wherein:
the at least one slot having a longitudinal axis extending in a non-radial direction with respect to the radiator.

6. The antenna of claim 1, wherein:
the first conductive surface, the second conductive surface and the thickness between the first conductive surface and second conductive surface are a unitary conductive material;
the at least one slot traverses the first conductive surface and only a partial portion of the thickness and ends before traversing the second conductive surface.

7. An antenna for filling a null at a zenith comprising:
a radiator,
the radiator having a first end, a second end, and a length, the radiator radiating a signal;
a ground plane positioned at the first end,
the ground plane radiating the signal,
the ground plane containing a mechanism for creating polarization towards the second end;
the mechanism for creating polarization being entirely radially separated a distance from the radiator;
the mechanism for creating the polarization being a slot;
the ground plane being a planar member;
the planar member having a first surface, a second surface, and a thickness defined between the first surface and the second surface;
the slot extending through the first surface and a portion of the thickness;
the slot being positioned at a first distance from the radiator;
and further comprising a second slot positioned at a second distance from the radiator;
the slot and the second slot causing the signal to be out of phase.

8. The antenna of claim 7 wherein:
the slot extends through an entirety of the thickness and also through the second surface.

9. The antenna of claim 7 wherein:
the polarization is circular polarization;
the slot and the second slot cause the signal to be ninety degrees out of phase.

10. The antenna of claim 9 wherein:
a third slot traverses the first surface of the planar member,
the third slot traverses the second surface of the planar member thereby completely traversing the thickness of the planar member,
the third slot at the first distance from the radiator;
a fourth slot traverses the first surface of the planar member,
the fourth slot traverses the second surface of the planar member thereby completely traversing the thickness of the planar member,
the fourth slot at the second distance from the radiator.

11. The antenna of claim 10 wherein:
the first and third slots are one hundred eighty degrees apart and on opposite sides of the radiator;
the second and fourth slots are one hundred eighty degrees apart and on opposite sides of the radiator;
the first slot and third slot comprise an angle;
the second slot and fourth slot comprise a second angle.

12. The antenna of claim 11 wherein:
the angle is ninety degrees;
the second angle is ninety degrees.

13. The antenna of claim 7, wherein:
the first surface, the second surface and the thickness between the first surface and second surface are a unitary conductive material;
the slot traverses the first surface and only a partial portion of the thickness and ends before traversing the second surface.

14. A method for modifying a signal pattern of antenna, comprising:
providing an antenna having a radiator and a ground plane;
providing at least one slot in the ground plane,
the at least one slot being entirely radially separated a distance from the radiator;
positioning the at least one slot to interrupt and polarize a portion of a signal emanating through the ground plane and direct the signal toward a null of the antenna to increase a signal gain at the null;
providing the ground plane as a planar member having a first surface, a second surface, and a thickness defined between the first surface and the second surface;
extending the at least one slot through the first surface and a portion of the thickness;
positioning the slot being at a first distance from the radiator;
positioning a second slot at a second distance from the radiator;
providing that the slot and the second slot cause the signal to be out of phase.

15. The method of claim 14 wherein:
the at least one slot is made by stamping.

16. The method of claim 14 wherein:
the at least one slot is made by cutting.

17. The method of claim 14 wherein:
the at least one slot is made by a chemical etching.

18. The method of claim 14 wherein:
the at least one slot is formed by a circuit board manufacturing process.

19. The method of claim 14, and further comprising:
providing the first surface, the second surface and the thickness between the first surface and second surface as a unitary conductive material;
providing that the slot traverses the first surface and only a partial portion of the thickness and ends before traversing the second surface.

20. An antenna for filling a null at a zenith comprising:
a radiator,
the radiator having a first end, a second end, and a length, the radiator radiating a signal;
a ground plane positioned at the first end,
the ground plane radiating the signal,
the ground plane containing a mechanism for creating polarization towards the second end;
the mechanism for creating the polarization is an interrupter;
the ground plane is a planar member,
the planar member has a first surface, a second surface, and a thickness defined between the first surface and the second surface;
the interrupter is a slot,
the slot extends through the first surface and a portion of the thickness;
the slot extends through an entirety of the thickness and also through the second surface;

the slot is positioned at a first distance from the radiator;

a second slot is positioned at a second distance from the radiator;

the slot and the second slot cause the signal to be out of phase;

the polarization is circular polarization;

the slot and the second slot cause the signal to be ninety degrees out of phase;

a third slot traverses the first surface of the planar member, the third slot traverses the second surface of the planar member thereby completely traversing the thickness of the planar member, the third slot at the first distance from the radiator;

a fourth slot traverses the first surface of the planar member, the fourth slot traverses the second surface of the planar member thereby completely traversing the thickness of the planar member, the fourth slot at the second distance from the radiator.

21. The antenna of claim 20 wherein:

the first and third slots are one hundred eighty degrees apart and on opposite sides of the radiator;

the second and fourth slots are one hundred eighty degrees apart and on opposite sides of the radiator;

the first slot and third slot comprise an angle;

the second slot and fourth slot comprise a second angle.

22. The antenna of claim 21 wherein:

the angle is ninety degrees;

the second angle is ninety degrees.

23. An antenna, comprising:

a ground plane; and a radiator extending from the ground plane to radiate a signal;

the ground plane including at least one slot positioned therein to polarize a portion of an EM signal emanating through the ground plane in a direction of a free end of the radiator to increase a signal gain at a null position of the antenna;

the ground plane having an outer edge;

the at least one slot extending to the outer edge;

the ground plane being a planar member and having a first surface, a second surface, and a thickness defined between the first surface and the second surface;

the at least one slot extending through the first surface and a portion of the thickness;

the at least one slot being positioned at a first distance from the radiator;

and further comprising a second slot positioned at a second distance from the radiator;

the at least one slot and the second slot causing the signal to be out of phase.

24. An antenna, comprising:

a ground plane; and a radiator extending from the ground plane to radiate a signal;

the ground plane including at least one slot positioned therein to polarize a portion of an EM signal emanating through the ground plane in a direction of a free end of the radiator to increase a signal gain at a null position of the antenna;

the at least one slot having a longitudinal axis extending in a non-radial direction with respect to the radiator;

the ground plane being a planar member and having a first surface, a second surface, and a thickness defined between the first surface and the second surface;

the at least one slot extending through the first surface and a portion of the thickness;

the at least one slot being positioned at a first distance from the radiator;

and further comprising a second slot positioned at a second distance from the radiator;

the at least one slot and the second slot causing the signal to be out of phase.

25. An antenna, comprising:

a ground plane; and a radiator extending from the ground plane to radiate a signal;

the ground plane including at least one slot positioned therein to polarize a portion of an EM signal emanating through the ground plane in a direction of a free end of the radiator to increase a signal gain at a null position of the antenna;

the at least one slot being entirely radially separated a distance from the radiator;

the ground plane having a first conductive surface, a second conductive surface and a thickness between the first conductive surface and second conductive surface of a unitary conductive material;

the at least one slot traversing the first conductive surface and only a partial portion of the thickness and ending before traversing the second conductive surface.

* * * * *